US005634416A

United States Patent [19]

De Santis

[11] Patent Number: 5,634,416

[45] Date of Patent: Jun. 3, 1997

[54] DEVICE AND METHOD FOR FORMING AN ORNAMENTAL STITCH IN A SEWING MACHINE

[75] Inventor: Gennaro De Santis, Vigevano, Italy

[73] Assignee: Rimoldi Necchi S.R.L., Vigevano, Italy

[21] Appl. No.: 649,029

[22] Filed: May 16, 1996

[30] Foreign Application Priority Data

Jul. 25, 1995 [IT] Italy ..... MI95A1602

[51] Int. Cl.[6] ..... D05B 55/10; D05B 57/00

[52] U.S. Cl. ..... 112/163; 112/200; 112/475.17

[58] Field of Search ..... 112/163, 165, 112/200, 199, 197, 475.17, 475.18, 475.26, 221

[56] References Cited

U.S. PATENT DOCUMENTS 4,498,405 2/1985 Hanyu et al. ..... 112/163 X 4,546,716 10/1985 Babson et al. ..... 112/163 X 4,685,406 8/1987 Marchesi ..... 112/199

4,690,080 9/1987 Mikuni et al. ..... 112/200 X

*Primary Examiner*—Ismael Izaguirre

*Attorney, Agent, or Firm*—Laff, Whitesel, Conte & Saret, Ltd.

[57] ABSTRACT

In a device for forming ornamental stitch seams, which comprises two or more needles (3*a*, 3*b*) moving alternately backward and forward through a needle plate (2) and a looper (5) cyclically movable following an elliptical trajectory (t) under the needle plate (2), the needles (3*a*, 3*b*) describe inclined trajectories (y) to form, with the needle plate (2), an acute angle turned towards the sewing direction (A), for crossing the looper trajectory (t) at a "crossing area" that, relative to a vertical direction (v) passing by the point at which the needles (3*a*, 3*b*) get through the needle plate (2), is shifted in a direction opposite to the sewing direction (A).

8 Claims, 3 Drawing Sheets

DEVICE AND METHOD FOR FORMING AN ORNAMENTAL STITCH IN A SEWING MACHINE

BACKGROUND OF THE INVENTION

1. Field of the Invention

The present invention relates to a device and a method for forming an ornamental stitch in sewing machines, said device being of the type comprising a needle plate along which the workpiece is fed with a step-by-step movement according to a given sewing direction; at least two needles moving alternately backward and forward through the workpiece and the needle plate, following trajectories lying in vertical planes parallel to the sewing direction, said needles being each provided with a respective needle thread; a looper provided with a respective lower interlacing thread, cyclically movable along an elliptical elongate trajectory transversely of the sewing direction and extending below the needle plate to circumscribe the movement trajectories of the needles.

2. Prior Art

It is known that making seams with ornamental stitches, of the type identified in the United States Catalogue of Seams under Nos. 406 and 407 involves the use of at least two needles provided with respective needle threads, fastened in mutual side by side relation to a needle bar. Through said needle bar the needles are operated with a rectilinear reciprocating motion in a vertical direction, passing through a workpiece which is moved by a step-by-step movement in a given sewing direction over a needle plate provided with appropriate holes and/or cuts enabling passage of the needles.

Operating under the needle plate is a looper carrying a respective lower interlacing thread, mounted to the end of a supporting arm in turn fastened to a drive shaft disposed with an axis parallel to the sewing direction and substantially in alignment with an intermediate axis between the sewing needles.

By this drive shaft the looper is operated with a cyclic movement substantially describing an elloptical trajectory substantially extending in a horizontal plane below the needle plate, the major axis of which is oriented transversely of the sewing direction and circumscribes the movement trajectories of the needles.

To the ends of the present description, identified as "crossing" steps are those operating steps involved in the stitch formation in which the looper is slightly touched by the needles and vice-versa.

In more detail, for the stitch formation it is provided that the needles should carry out a down-stroke through the workpiece and the needle plate and, at the instant their up-stroke starts, should be "crossed" by the looper that enters corresponding looplike areas defined between the needles themselves and the respective needle threads. In this manner the needle threads, by the subsequent moving up of the needles, form respective loops that remain engaged in the looper. The lower interlacing thread carried by the looper is also inserted, together with said looper, into the loops formed by the needle threads and, being interlooped in the workpiece by effect of the previously formed sewing stitch, defines with the looper itself an insertion interspace having a substantially triangular conformation, the amplitude of which is correlated with the length of the sewing stitch, that is the movement pitch that is imposed to the workpiece when the needles, in the end step of their up-stroke and at the beginning of their new down-stroke, are extracted from the workpiece.

Concurrently with the workpiece displacement, the looper is slightly moved in a direction opposite to the sewing direction by an axial translation of the drive shaft, so that it is in side-by-side relationship with the needle trajectories at the front, that is on the opposite side from said looplike areas.

When the new down-stroke of the needles begins, said needles must slightly touch the looper while entering the triangular interspace defined by the looper itself with the respective lower interlacing thread, whereupon the looper is brought back to the starting position leaving the lower interlacing thread engaged around the needles and it is ready to enter again the above mentioned looplike areas as soon as the needles begin their new up-stroke.

From the foregoing it is apparent that at the present state of the art, the execution of the ornamental stitch has some limits. First of all, insertion of the needles in the triangular interspace formed by the looper and the lower interlacing thread is very critical, due to the reduced size of this interspace. As a result, in order to ensure a correct insertion of the needles, a slight interference must be necessarily produced between the looper and the needles during the looper crossing step, over an inclined surface arranged for the purpose.

These mechanical interferences however, inevitably give rise to important restrictions in the operating speed of the sewing machine, in that they cause overheating of the needles which will give rise to possible breaking of the same and/or burning of the threads. It is also to note that the needles, due to their slenderness are greatly affected by the effects of a combined bending and compressive stress when they operate at high speed, which will bring about, as a result, bendings and deformations the extent of which can be hardly established a priori. Adjustment of the interference between the needles and the looper is therefore even more difficult and critical, in spite of the aid of appropriate guide members such as the so-called "needle-pushers" and/or "needle-protecting elements".

It is also to note that, in order that a sufficient length of the needle threads may be drawn off during the needle descent, it is impossible to conveniently reduce the stroke performed by said needles to values under 30 mm. This condition represents another limitation to the operating speeds that can be achieved by the present sewing machines conveniently set up for making ornamental stitch seams. It is in fact apparent that a greater operating speed could be achieved, if said needles were able to perform reduced operating strokes.

Another problem presently found is given by the fact that the loops formed by the needles inevitably tend to be dragged along by the looper when the latter, during its return stroke, is about to be drawn out of the loops themselves. This situation causes the loops formed by the needle threads to be gathered together and mutually overlapped as a result of the looper movement, thereby giving rise to a seam of unacceptable quality or to breaking of the threads, above all when thread tensioning is not perfectly adjusted and/or when seams are made with the use of more than two needles and the distance between centers of these needles is reduced.

SUMMARY OF THE INVENTION

In accordance with the present invention, it has been found that the problems of the known art can be brilliantly solved by arranging the needles so that they can move following a suitably inclined trajectory in order to form, with the needle plate, an acute angle turned towards the feed direction of the workpiece in the same manner as in common sewing machines adapted to form an overcasting stitching. In this manner in fact, the looper can be advantageously moved forward relative to the vertical line passing by the point at which the needles get through the needle plates so that the lower interlacing thread forms with the looper an insertion interspace which at all events has greatly larger sizes than those presently found in the known art devices in which the needles move along a perfectly vertical trajectory.

In more detail, the invention relates to a device for forming an ornamental stitch in a sewing machine, wherein the movement trajectories of the needles are inclined to form with the needle plate an acute angle of incidence turned towards the sewing direction, so as to cross the looper trajectory at a crossing area that is shifted in a direction opposite to the sewing direction, with respect to a vertical direction passing by the point at which the needles get through the needle plate.

It is a further object of the invention a sewing method put into practice by said device.

BRIEF DESCRIPTION OF THE DRAWINGS

Further features and advantages will become more apparent from the detailed description of a preferred and non-exclusive embodiment of a device and method for forming an ornamental stitch in a sewing machine in accordance with the present invention, which is taken hereinafter with reference to the accompanying drawings given by way of non-limiting example, in which.

DESCRIPTION OF THE PREFERRED EMBODIMENT

Figure 3:
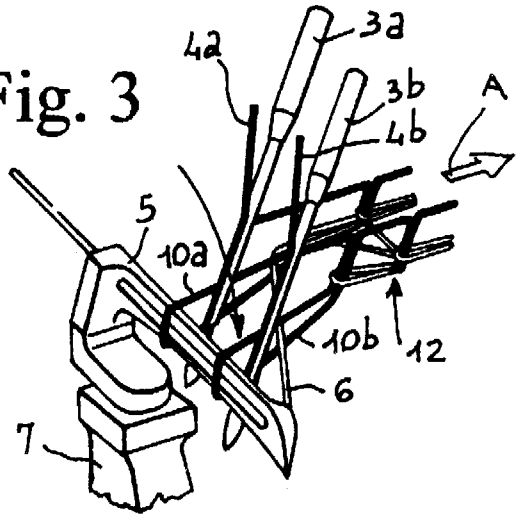
FIG. 3 is a perspective view showing from a different angle with respect to the preceding figures, the step (corresponding to FIG. 2*d*) in which the needles "cross" the looper while entering the triangular interspace.

Referring to the drawings, a device for forming an ornamental stitch on sewing machines, in accordance with the present invention, has been generally identified by reference numeral 1.

In a manner known per se, the device 1 essentially comprises a needle plate 2 along which a workpiece not shown for the sake of clarity, is moved forward or fed by a step-by-step movement in a predetermined sewing direction identified by arrow "A", by means of feed dogs operating through the needle plate and also not shown, because they are known and not of importance to the ends of the invention.

Figure 1:
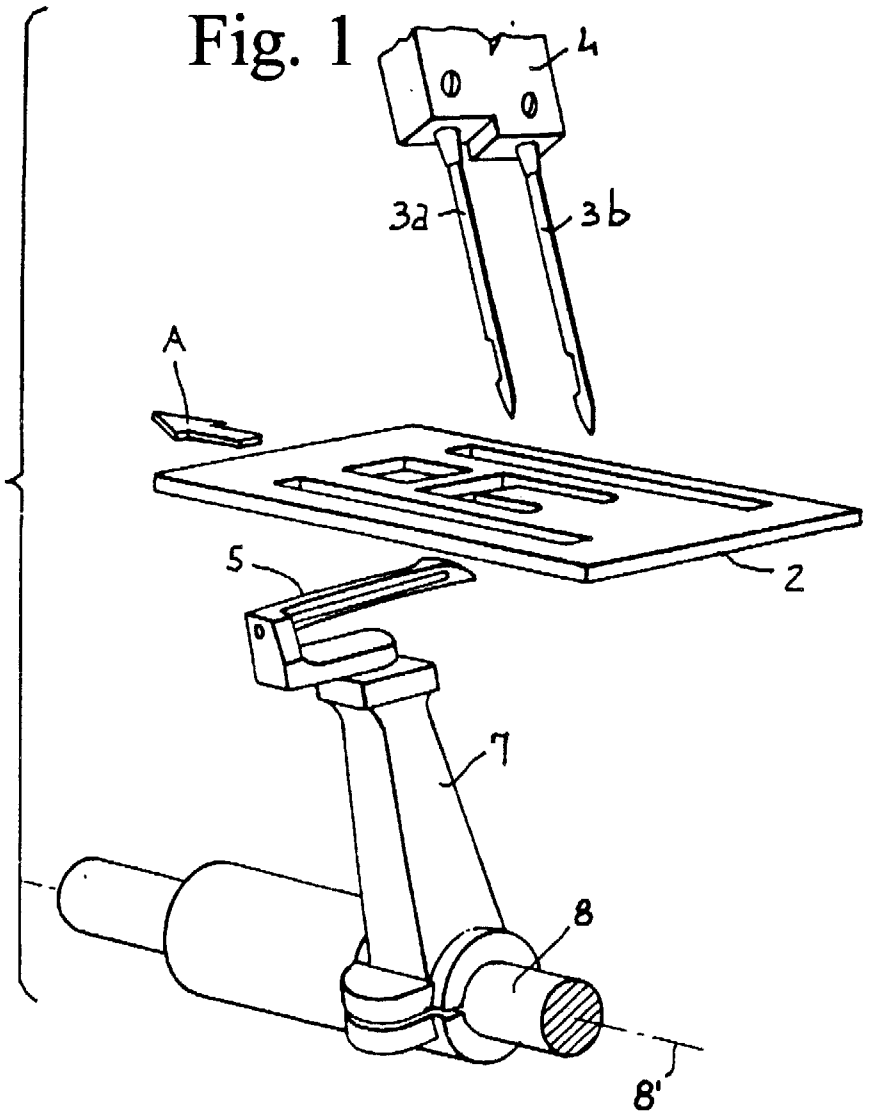
FIG. 1 is a perspective view of a device for forming an ornamental stitch in accordance with the invention.

The device 1 also comprises at least two needles 3*a*, 3*b* identified as outer needle 3*a* and inner needle 3*b* respectively, usually fastened to a needle bar 4, only the lower end portion of which is shown in FIG. 1, and each provided with a respective needle thread 4*a*, 4*b*.

The needles 3*a*, 3*b* are reciprocated with a rectilinear movement by means of the needle bar 4, through the needle plate 2 and the workpiece disposed thereon, following directions lying in corresponding vertical planes parallel to the sewing direction "A". The needles 3*a*, 3*b* cooperate with a looper 5 acting under the needle plate 2 for the purpose of forming an ornamental stitch seam, denoted by 12 in FIGS. 2*a*, 2*b*, 2*c*, 2*d* and 3.

In more detail, the looper 5 is provided with a respective lower interlacing thread 6, and is fastened to the top of a supporting arm 7 in turn connected to a drive shaft 8 engaged in the sewing machine bed, not shown, according to an axis 8' parallel to the sewing direction "A".

Figure 5:
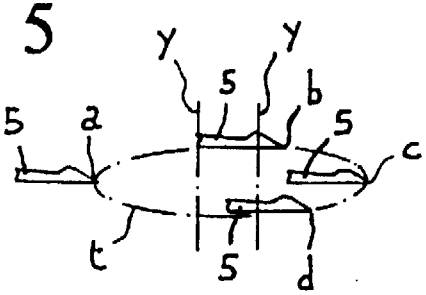
FIG. 5 is a diagrammatical plan view of the elliptical trajectory covered by the looper compared with the trajectories taken by the needles, and the different positionings taken by the looper during the steps referred to in FIGS. 2*a*, 2*b*, 2*c* and 2*d* respectively.

In operation, a cyclic movement is imparted to the looper 5 by the drive shaft 8 and supporting arm according to a substantially elliptical trajectory shown by line "t" in FIG. 5, extending transversely of the sewing direction "A" and circumscribing the movement trajectories "y" of the needles. This elliptical trajectory "t" is obtained by the combination between an angular oscillation motion about the axis 8' of the drive shaft 8, and a reciprocating motion of axial translation relative to the shaft itself.

Figure 2B:
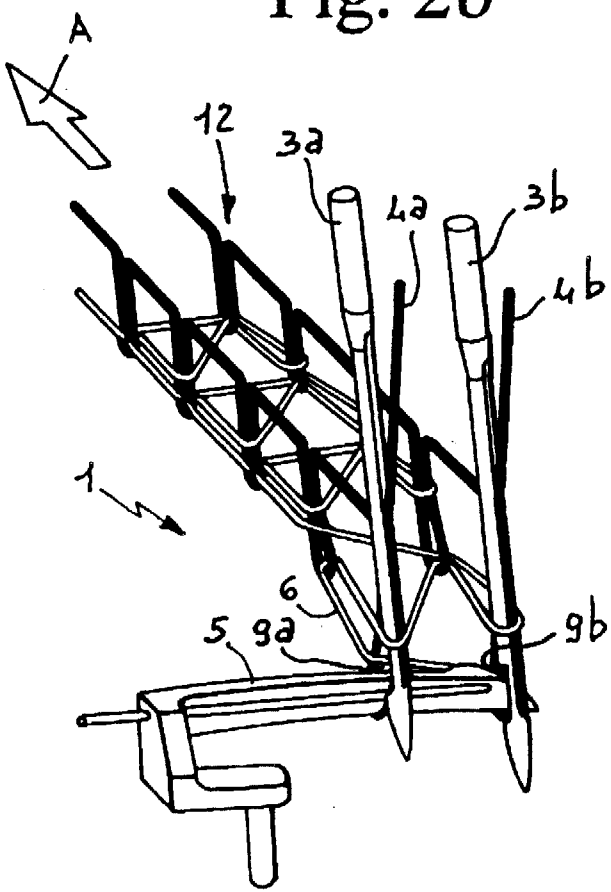
FIGS. 2*a* to 2*d* are perspective views showing the mutual positioning taken by the essential components of the device in reference during different steps of the operating cycle for forming the inventive ornamental stitch.
Figure 2A:
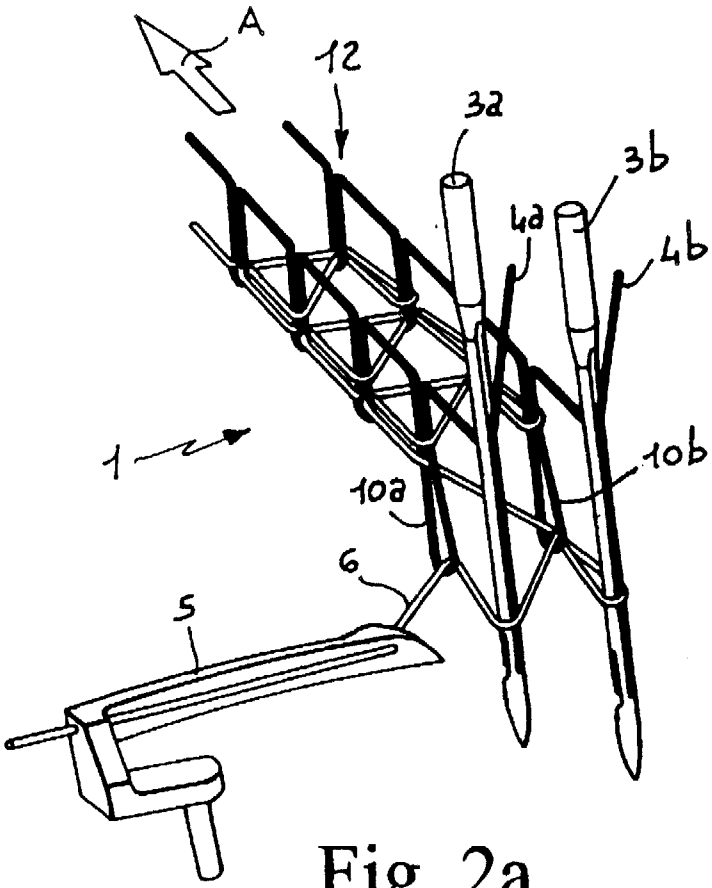

In a manner known per se, the ornamental stitch formation takes place following an operating cycle in which, considering starting from a step in which the needles 3*a*, 3*b* have already been inserted through the workpiece and the needle plate 2 and are about to begin their up-stroke, the looper 5 is caused to move transversely of the sewing direction for crossing the needles and inserting, by its own tip 5*a*, into looplike areas 9*a*, 9*b* each defined between one of the needles 3*a*, 3*b* and the corresponding needle thread 4*a*, 4*b*, as shown in FIG. 2*b*. Denoted by "b" in FIG. 5 is the position of looper 5 corresponding to the reference step shown in FIG. 2*b*.

Figure 2D:
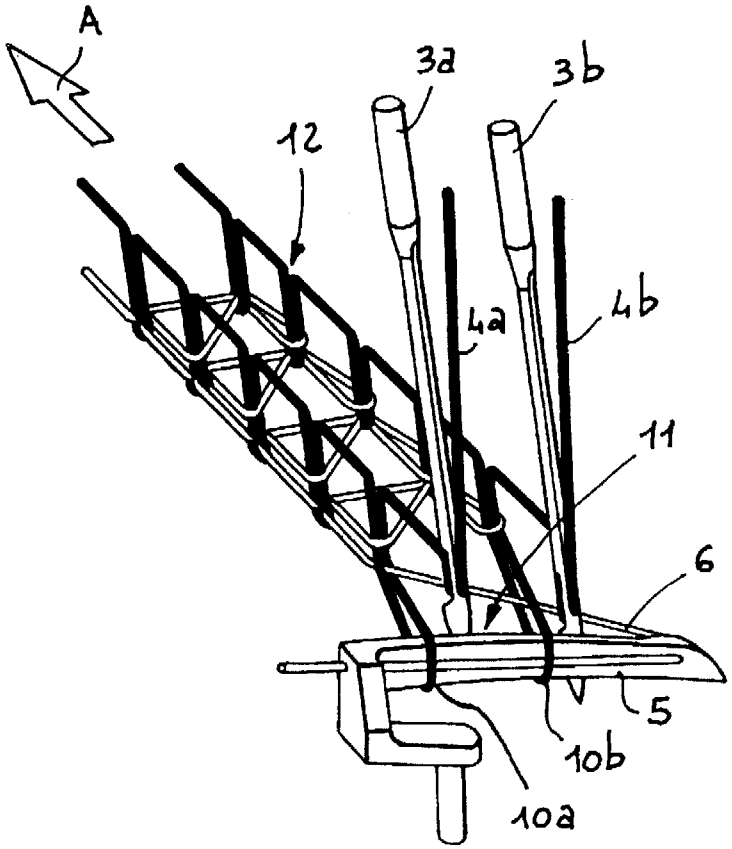
Figure 2C:
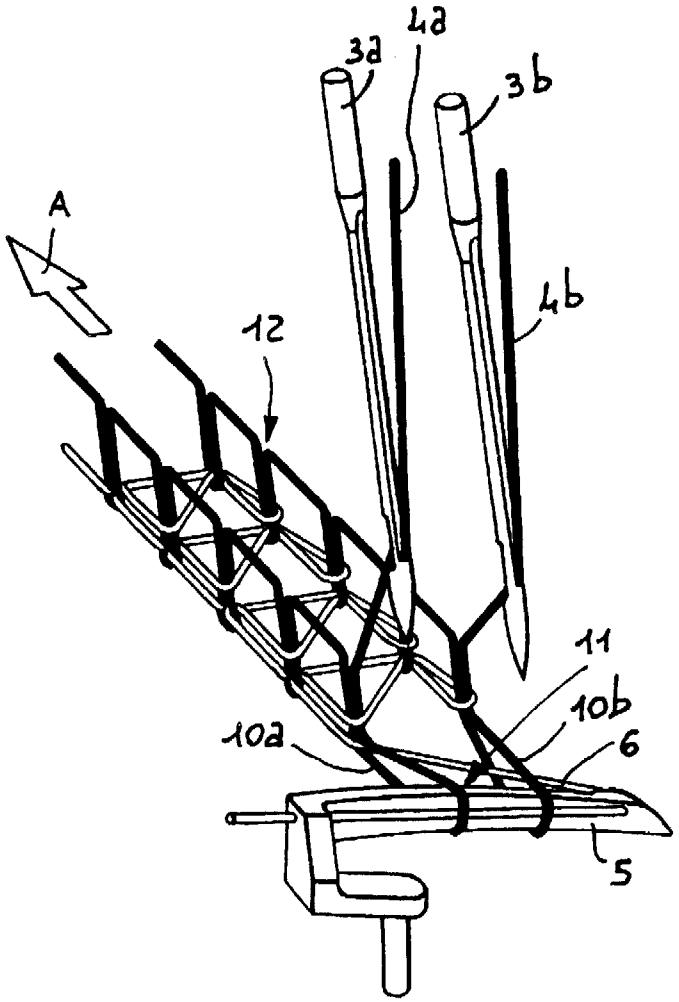

While the looper 5 is about to finish its advance movement, the needles 3*a*, 3*b* carry out an up-stroke and are therefore extracted from the needle plate 2 and the workpiece, whereas the needle threads 4*a*, 4*b* form respective loops 10*a*, 10*b* that remain engaged about the looper itself, as shown in FIG. 2*c*. Denoted by "c" in FIG. 5 is the position taken by the looper 5 at the step shown in FIG. 2*c*.

While the needles 3*a*, 3*b* are about to reverse their movement at the upper dead point of their stroke, the workpiece is moved forward on the needle plate 2 over a predetermined length that is variable depending on the stitch length that one wishes to obtain. At the same time, the looper 5, while reversing its movement at the dead point of its advance stroke, moves in the opposite direction relative to the sewing direction "A", and is arranged in side-by-side relationship with the movement direction "y" of the needles, on the opposite side with respect to the previously mentioned insertion looplike areas 9*a*, 9*b*.

In more detail, whereas during the insertion into the looplike areas 9*a*, 9*b* the looper 5 has "crossed" the needles at the rear of the needles themselves, that is at their part oriented towards the sewing direction "A", following the above mentioned displacement the looper is located immediately before the movement trajectories "y" of the needles.

By a new down-stroke, the needles 3*a*, 3*b* are then introduced into the workpiece and the needle plate the looper 5 being "crossed" as shown in FIG. 2*d*, so as to enter a substantially triangular interspace 11 defined by the looper itself and the respective lower interlacing thread 6 which is engaged with the workpiece by effect of the previously produced sewing stitch. At this instant the looper 5 has the positioning identified by "d" in FIG. 5.

While the needles 3a, 3b are about to reverse their movement at the lower dead point of their stroke, the looper 5 moves backward towards its starting dead point, causing disengagement of the loops 10a, 10b of the needle threads 4a, 4b, engaged in the preceding insertion step. At the end of the return stroke, the looper 5 takes the position shown in FIG. 2a corresponding to the positioning denoted by "a" in FIG. 5, and the lower interlacing thread 6 is inserted into the loops 10a and engaged in front of the needles 3a, 3b that are about to start their up-stroke. In the initial step of this up-stroke of needles 3a, 3b, the looper 5 will be inserted again into the looplike areas 9a, 9b to start the formation of a new sewing stitch, as shown in FIG. 2b.

From the foregoing it is apparent that, in accordance with the present invention, the movement trajectories of needles 3a, 3b, instead of being perfectly vertical as they are found in the known art, have an inclined extension so as to form, with the needle plate 2, an acute angle of incidence identified by "α" turned towards the sewing direction "A". In a preferential embodiment, this angle "α" is of 70√ but, to the ends of the present invention, it can take any other value, included between 60° and 85° for example.

Figure 4:
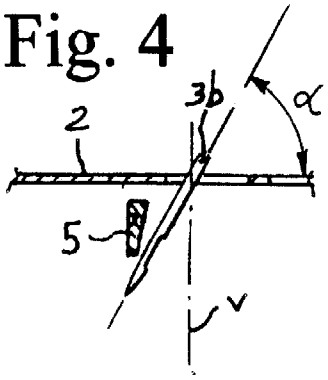
FIG. 4 is a sectional side view showing the mutual positioning of the needles, looper and needle plate in the step referred to in the preceding figure.

As shown in FIG. 4, by virtue of this expedient, the elliptical trajectory "t" described by looper 5, inside which is confined the crossing area with the movement trajectories "y" of needles 3a, 3b, appears to be shifted forward, that is in a direction opposite to the sewing direction "A", relative to a vertical direction "v" passing by the point at which the needles get through the needle plate 2.

In more detail, the displacement of the elliptical trajectory "t" may be provided to be of such an extent that the vertical line "v" passes externally of the elliptical trajectory itself.

In other words, whereas in the devices of the known art the major axis of the elliptical trajectory "t" was substantially intersected by the above described vertical line "v", the present invention enables the looper to be maintained in a forward-shifted position relative to said vertical direction, and therefore relative to the point at which the needle threads 4a and the lower interlacing thread 6 remain in engagement with the workpiece by effect of the previously produced sewing stitch.

This solution causes the lower interlacing thread 6 to be greatly spread apart from looper 5 when, as shown in FIG. 2d, the needles have to be inserted in the above specified triangular interspace 11. In other words, the invention enables the achievement of a triangular interspace much wider than that found in the devices of the known art, where, clue to positioning of the looper 5 substantially in vertical alignment with the insertion point of the needles 3 in the fabric, this interspace had greatly reduced sizes because the lower interlacing thread maintained an orientation almost parallel to the looper 5, above all when seams with a very reduced stitch length had to be made and therefore the movement pitch of the workpiece was correspondingly limited.

The width of the triangular interspace 11 achieved by the present invention therefore enables insertion of the needles between the looper 5 and the lower interlacing thread 6 to be greatly facilitated, so that provision of mechanical interferences between these elements in order to ensure the correct execution of a seam is no longer necessary. Also the necessity to provide guide members for the needles, such as usual needle-pushing and needle-protecting elements is eliminated, said elements too in the known art creating undesired mechanical interferences penailizing the obtainable operating speed of the sewing machines.

Still in accordance with the present invention, it is also provided that the axis 8' of the drive shaft 8, that is the oscillation axis of the looper 5, should be laterally offset relative to the distance between centers of the needles by a value included between 5 and 15 mm, preferably equal to 11 mm.

In this manner, when the looper 5 moves to the dead point of its advance stroke, it is subjected to carry out a slight lowering relative to the needle plate 2, when its insertion into the looplike areas 9a, 9b occurs. This lowering imposed by looper 5 causes the needles to draw off a slightly greater amount of thread than the length resulting from the stroke carried out by them. Therefore, by virtue of the present invention it is possible to reduce the stroke of needles 3a, 3b to a value of about 26 mm for example, without this fact involving problems resulting from a lower amount of thread drawn off by said needles during their down-stroke.

In addition, when the looper moves backward to its return end of stroke, it is subjected to a slight lifting promoting extraction of the looper itself from the loops 10a, 10b, thereby eliminating the risk that the loops may be gathered and mutually overlapped by effect of a dragging action they receive from the looper, above all when seams involving the use of three or more needles are to be made and said needles have a closely spaced distance between centers.

It is therefore apparent that the present invention enables an important improvement to be obtained in the work conditions of the different members cooperating in forming an ornamental stitch, which in conclusion will make it possible to operate at speeds never reached until now.

It is to note that advantageously the device of the present invention can be embodied by adapting a conventional sewing machine, initially envisaged for the formation of overcasting stitchings, to execute ornamental stitch seams.

In fact, as known, overcasting machines have one or more needles movable in an inclined trajectory, and a lower looper mounted on a drive shaft positioned as described with reference to the present invention. In spite of that, it is to note that the specificity of use of these overcasting machines has made it unthinkable until now to try to adapt them to the execution of ornamental stitch seams, as proposed in an original manner in the present invention.

Obviously, many modifications and variations can be made to the invention as conceived, all of them falling within the scope of the invention idea characterizing it.

What is claimed is:

1. A device for forming an ornamental stitch in sewing machines, comprising:

a needle plate (2) along which the workpiece is fed in a step-by-step movement according to a given sewing direction (A);

at least two needles (3a, 3b) moving alternately backward and forward through the workpiece and the needle plate (2), following trajectories (y) lying in vertical planes parallel to the sewing direction (A), said needles (3a, 3b) being each provided with a respective needle thread (4a, 4b);

a looper (5) provided with a respective lower interlacing thread (6), cyclically movable along an elliptical elongate trajectory (t) transversely of the sewing direction (A) and extending below the needle plate (2) to circumscribe the movement trajectories (y) of the needles (3a, 3b), wherein the movement trajectories (y) of the needles (3a, 3b) are inclined to form, with the needle plate (2), an acute angle of incidence (α) turned towards the sewing direction (A) and the elliptical movement trajectory (t) of the looper (5) is shifted in a direction opposite to the sewing direction (A), with respect to a vertical direction (v) passing by the point at which the needles (3a, 3b) get through the needle plate (2).

2. The device as claimed in claim 1, wherein said angle of incidence (α) is included between 60° and 85°.

3. The device as claimed in claim 1, wherein said angle of incidence (α) is equal to 70°.

4. The device as claimed in claim 1, wherein said vertical direction (v) passes externally of the elliptical movement trajectory (t) of the looper (5).

5. The device as claimed in claim 1, wherein the looper (5) is oscillating about an axis (8') parallel to the sewing direction (A) and laterally offset by a measure included between 5 and 15 mm, with respect to the distance between centers of the needles (3a, 3b).

6. A method of forming an ornamental stitch in sewing machines, involving the use of at least one needle plate (2) along which a workpiece is fed with a step-by-step movement in a given sewing direction at least two needles (3a, 3b) provided with respective needle threads (4a, 4b) and reciprocating through the workpiece and the needle plate (2) following trajectories (y) lying in planes parallel to the sewing direction (A), and a looper (5) provided with a respective lower interlacing thread (6), cyclically movable under the needle plate (2) in a substantially elongate elliptical trajectory (t) transversely of the sewing direction (A) and circumscribing the movement trajectories (y) of the needles (3a, 3b), said method comprising the steps of:

moving the looper (5) forward to insert it, together with the respective lower interlacing thread (6), into insertion looplike areas (9a, 9b) defined between each needle (3a, 3b), previously inserted through the workpiece and the needle plate (2), and the respective needle thread (4a, 4b) engaged in the workpiece and the needle plate (2);

extracting the needles (3a, 3b) from the needle plate (2) and the workpiece, said needle threads (4a, 4b) forming respective loops (10a, 10b) remaining in engagement with the looper (5);

causing the workpiece to move forward following said sewing direction (A) and moving the looper (5) in a direction opposite to the sewing direction (A) to arrange it in a position in side by side relationship with the movement direction (y) of the needles (3a, 3b), on the opposite side from said insertion looplike areas (9a, 9b);

inserting the needles (3a, 3b) through the workpiece and the needle plate (2), as well as into a substantially triangular insertion interspace defined between the looper (5) and the respective lower interlacing thread (6);

moving the looper (5) backward for extracting it from the needle thread loops (10a, 10b), wherein insertion and extraction of the needles (3a, 3b) take place following inclined movement trajectories (y) forming with the needle plate (2) an acute angle of incidence (α) turned towards the sewing direction (A), and the looper movement occurs following a substantially elliptical trajectory (t) shifted in a direction opposite to the sewing direction (A) relative to a vertical direction (v) passing by the point at which the needles (3a, 3b) get through the needle plate (2).

7. The method as claimed in claim 6, wherein the looper (5) is lowered relative to the needle plate (2) during its insertion into the looplike areas (9a, 9b) defined between the needles (3a, 3b) and the respective needle threads (4a, 4b).

8. The method as claimed in claim 7, wherein the looper (5) is lifted towards the needle plate (2) during its backing step.

* * * * *

UNITED STATES PATENT AND TRADEMARK OFFICE

CERTIFICATE OF CORRECTION

PATENT NO. : 5,634,416

DATED : June 3, 1997

INVENTOR(S) : Gennaro De Santis

It is certified that error appears in the above-indentified patent and that said Letters Patent is hereby corrected as shown below:

IN THE CLAIMS:

claim 6, col. 7, ln. 21: "direction at least" should be "direction (A), at least"

claim 6, col. 8, ln. 15: "insertion interspace defined" should be "insertion interspace (11) defined"

Signed and Sealed this

Second Day of September, 1997

*Attest:*

*Attesting Officer*

BRUCE LEHMAN

*Commissioner of Patents and Trademarks*